US009209561B2

(12) United States Patent
Miyakawa et al.

(10) Patent No.: US 9,209,561 B2
(45) Date of Patent: Dec. 8, 2015

(54) CONNECTOR STRUCTURE

(71) Applicant: YAZAKI CORPORATION, Minato-ku, Tokyo (JP)

(72) Inventors: Tomoyuki Miyakawa, Utsunomiya (JP); Kazuto Ohtaka, Makinohara (JP); Hideki Honma, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/519,237

(22) Filed: Oct. 21, 2014

(65) Prior Publication Data

US 2015/0111409 A1 Apr. 23, 2015

(30) Foreign Application Priority Data

Oct. 23, 2013 (JP) ..... 2013-220002

(51) Int. Cl.

| | |
|---|---|
| ***H01R 4/48*** | (2006.01) |
| ***H01R 13/627*** | (2006.01) |
| ***H01R 13/641*** | (2006.01) |
| *H01R 13/703* | (2006.01) |

(52) U.S. Cl.

CPC ..... *H01R 13/6273* (2013.01); *H01R 13/641* (2013.01); *H01R 13/7032* (2013.01); *H01R 2201/26* (2013.01)

(58) Field of Classification Search

CPC ..... H01R 4/4872; H01R 13/745
USPC ..... 439/817, 565, 550, 557, 824, 916
See application file for complete search history.

(56) References Cited

U.S. PATENT DOCUMENTS 4,111,513 A * 9/1978 Thurston ..... H01R 9/032 439/607.47
7,544,068 B2 * 6/2009 Glaab, III ..... H01R 13/512 439/607.01
7,896,687 B1 * 3/2011 Schweitzer ..... H01R 9/032 439/320
2004/0097116 A1 5/2004 Osada
2011/0053421 A1 * 3/2011 Mostoller et al. .... H01R 13/562 439/625

FOREIGN PATENT DOCUMENTS

| | | |
|---|---|---|
| JP | 2004-171843 A | 6/2004 |
| JP | 2005-255061 A | 9/2005 |
| WO | 2013/015451 A2 | 1/2013 |

OTHER PUBLICATIONS

The extended European search report letter issued on Mar. 3, 2015 in the counterpart European patent application.

* cited by examiner

*Primary Examiner* — Phuongchi T Nguyen
(74) *Attorney, Agent, or Firm* — Marvin A. Motsenbocker; MOTS Law, PLLC

(57) ABSTRACT

A connector structure includes a first connector and a second connector. The first connector includes a first connector housing and an engagement arm that can be elastically bent. The second connector includes a second connector housing, a slider provided on the second connector housing, a biasing portion that biases the second connector housing in a connector decoupling direction, and an arm engagement portion engaged with the engagement arm. During a coupling process of the first and second connectors, the slider is slid by a pressing force applied from the first connector against a biasing force generated by the biasing portion. The biasing portion includes an elastically-bendable arm provided on the slider, and a tapered surface provided on the second connector housing. The biasing force is generated as a reaction force of an elastically-restorative force of the elastically-bendable arm bent by the tapered surface.

4 Claims, 12 Drawing Sheets

CONNECTOR STRUCTURE

BACKGROUND OF THE INVENTION

1. Technical Field

The present invention relates to a connector structure that can prevent an insufficient coupling of connectors.

2. Background Arts

FIG. 7 to FIG. 10 show a prior-art connector structure for avoiding an insufficient coupling of connectors. As shown in FIG. 10, a connector set 100 includes a first connector 110 and a second connector 120 that are coupled with each other. As shown in FIG. 8, the first connector 110 includes a first connector housing 111. A pair of first terminals 112, a shunt ring 13, and a short-circuit terminal 114 are housed in the first connector housing 111. As shown in FIG. 9, the second connector 120 includes a second connector housing 122 that houses a pair of second terminals 121 to be connected with the first terminals 112, respectively, a slider 123 provided on the second connector housing 122 slidably in a connector coupling direction and a connector decoupling direction, a coil spring (metal spring) 124 that urges the first connector 110 in the decoupling direction, a cover 125 attached to the second connector housing 122, and a ferrite core 126. As shown in FIG. 10, the coil spring 124 is interposed between the second connector housing 122 and the slider 123.

In the above-explained configuration, during a coupling process of the first connector 110 and the second connector 120, the second connector housing 122 is inserted into the first connector housing 111 to connect the second terminals 121 with the first terminals 112 electrically. During the above coupling process, the coil spring 124 is compressed while the slider 123 is slid on the second connector housing 122, and thereby the first connector 110 is urged by the slider 123 in the connector decoupling direction (leftward in FIG. 10) due to an elastically-restorative force of the coil spring 124. If the coupling process is stopped before the coupling process is completed, the first connector 110 is decoupled from the second connector due to the elastically-restorative force of the coil spring 124. Therefore, an insufficient coupling between the shunt ring 113 of the first connector 110 and the second connector housing 122 of the second connector 120 can be avoided.

FIG. 11 and FIG. 12 show another prior-art connector structure for avoiding an insufficient coupling of connectors. For example, this type of the connector structure is disclosed in Japanese Patent Application Publication No. 2005-255061, and Japanese Patent Application Publication No. 2004-171843. As shown in FIG. 11 and FIG. 12, a female connector 130 includes a housing 131 in which a pair of female terminals (not shown) are housed, and a male connector 152 includes a housing 151, a shunt 140 that is attached to the housing 151, and a pair of male terminals 142 to be connected with the pair of female terminals, electrically. The male connector 152 is provided also with a squib 150 for an airbag inflator, and the squib 150 will be ignited electrically. A pair of tabs 136 is extended from the housing 131 of the female connector 130, and a pair of wedges 138 is formed on each of the tabs 136.

The female connector 130 also includes a slider 134 that penetrates through the housing 131 and can slide along a boss 133. The slider 134 is provided with a pair of movable wedges 137, and each of the movable wedges 137 slides in a hole formed on each of the tabs 136 when a head 135 of the slider 134 is pushed to slide the slider 134. Engagement projections 141 inclined outward are provided on an outer circumference of the shunt 140. The engagement projections 141 can be elastically deformed inward. An engagement rib 154 is formed circumferentially on an inner circumferential surface of the shunt 140, and the engagement projections 141 and the engagement rib 154 are engaged with each other when the shunt 140 is attached to the housing 151. An engagement groove 153 is also formed circumferentially on the inner circumference surface of the shunt 140. The engagement projections 141 are located within the engagement groove 153 when the shunt 140 is attached to the housing 151.

According to the above-explained configuration, when the female connector 130 is temporally attached to the male connector 152 (the head 135 is lifted up), the wedges 138 are engaged with the engagement groove 153 to hold the female connector 130 temporarily. Then, the head 135 is pushed to slide the slider 134. Here, if the housing 131 and the shunt 140 are engaged with each other completely (sufficiently), the slider 134 can be pushed into the housing 131, and thereby side faces of the slider 134 pushes the tabs 136 onto the inner circumferential surface of the shunt 140. Therefore, the wedges 138 are securely engaged with the engagement groove 153. In addition, the movable wedges 137 are also engaged with the engagement groove 153 to lock the slider 134. Further, in this state, erroneous removal of the shunt 140 from the housing 151 (i.e. erroneous uncoupling of the female connector 130 from the male connector 152) is avoided by engagements of the engagement projections 141 and the engagement rib 154.

On the other hand, if the housing 131 and the shunt 140 are engaged with each other incompletely (insufficiently), the wedges 138 are not engaged with the engagement groove 153, and thereby the tabs 136 are bent inward. Therefore, the slider 134 cannot be pushed into the housing 131, because its insertion is inhibited by the tabs 136 bent inward. As a result, the female connector 130 cannot be coupled with the male connector 152, and an insufficient coupling of the connectors 130 and 152 is avoided.

SUMMARY OF THE INVENTION

However, according to the connector structure shown in FIG. 7 to FIG. 10, the coil spring 124 is needed as a biasing portion for biasing the first connector 110 in the connector decoupling direction via the slider 123, so that man hours required for assembling the connector set 100 and costs for components of the connector set 100 are subject to increase.

In addition, according to the connector structure shown in FIG. 11 and FIG. 12, if pushing of the slider 134 (the head 135) is missed, the insufficient coupling of the connectors 130 and 152 cannot be noticed and detected. Therefore, the insufficient coupling of the connectors 130 and 152 cannot be avoided securely, and products with the insufficient coupling of the connectors may be shipped out without being noticed.

An object of the present invention is to provide a connector structure that can prevent an insufficient coupling of connectors, and can reduce assembling man hours and component costs.

An aspect of the present invention provides a connector structure connector structure comprising: a first connector that includes a first connector housing in which a first terminal is housed, and an engagement arm that can be elastically bent; and a second connector that includes a second connector housing in which a second terminal is housed, a slider that is provided on the second connector housing slidably in a connector coupling direction and a connector decoupling direction, a biasing portion that biases the second connector housing in the connector decoupling direction, and an arm engagement portion engaged with the engagement arm when the engagement arm is elastically bent back, wherein, during a coupling process of the first connector and the second connector, the slider is slid by a pressing force applied from the first connector against a biasing force generated by the biasing portion, in a coupling completion state, the engagement arm is engaged with the arm engagement portion to lock the first connector and the second connector, the biasing portion includes an elastically-bendable arm that is provided on the slider, and a tapered surface that is provided on the second connector housing and contacts with the elastically-bendable arm to bend the elastically-bendable arm during the coupling process, and the biasing force is generated as a reaction force of an elastically-restorative force of the elastically-bendable arm bent by the tapered surface.

According to the aspect, during the coupling process, the elastically-bendable arm provided on the slider is bent by the tapered surface provided on the second connector housing, and thereby the second connector is biased by the biasing force generated as a reaction force of an elastically-restorative force of the elastically-bendable arm. Therefore, if the coupling process is stopped before the coupling process is completed, the first connector is decoupled from the second connector by the biasing force. As a result, an insufficient coupling between the first connector and the second connector can be prevented securely. In addition, the biasing force is generated by the biasing portion, so that man hours required for assembling the connector structure can be reduced and costs for components of the connector structure can be also reduced.

It is preferable that during the coupling process, the engagement arm is bent so as to be contacted with the elastically-bendable arm, the elastically-bendable arm provided on the slider is moved by being pushed by the engagement arm against the biasing force, and the engagement arm is bent back and the elastically-bendable arm is moved back to an elastically bent area of the engagement arm between the engagement arm and the first connector housing when the coupling process is completed. It is also preferable that the elastically-bendable arm is formed integrally with the slider.

In addition, it is preferable that the biasing portion is provided in a pair, one of the biasing portions and another of biasing portions are arranged line-symmetrically to generate the elastically-restorative force generated by the one and the elastically-restorative force generated by the other oppositely, and the biasing force is generated as a resultant force of the reaction force of the elastically-restorative force generated by the one and the reaction force of the elastically-restorative force generated by the other.

DESCRIPTION OF THE EMBODIMENTS

Figure 1:
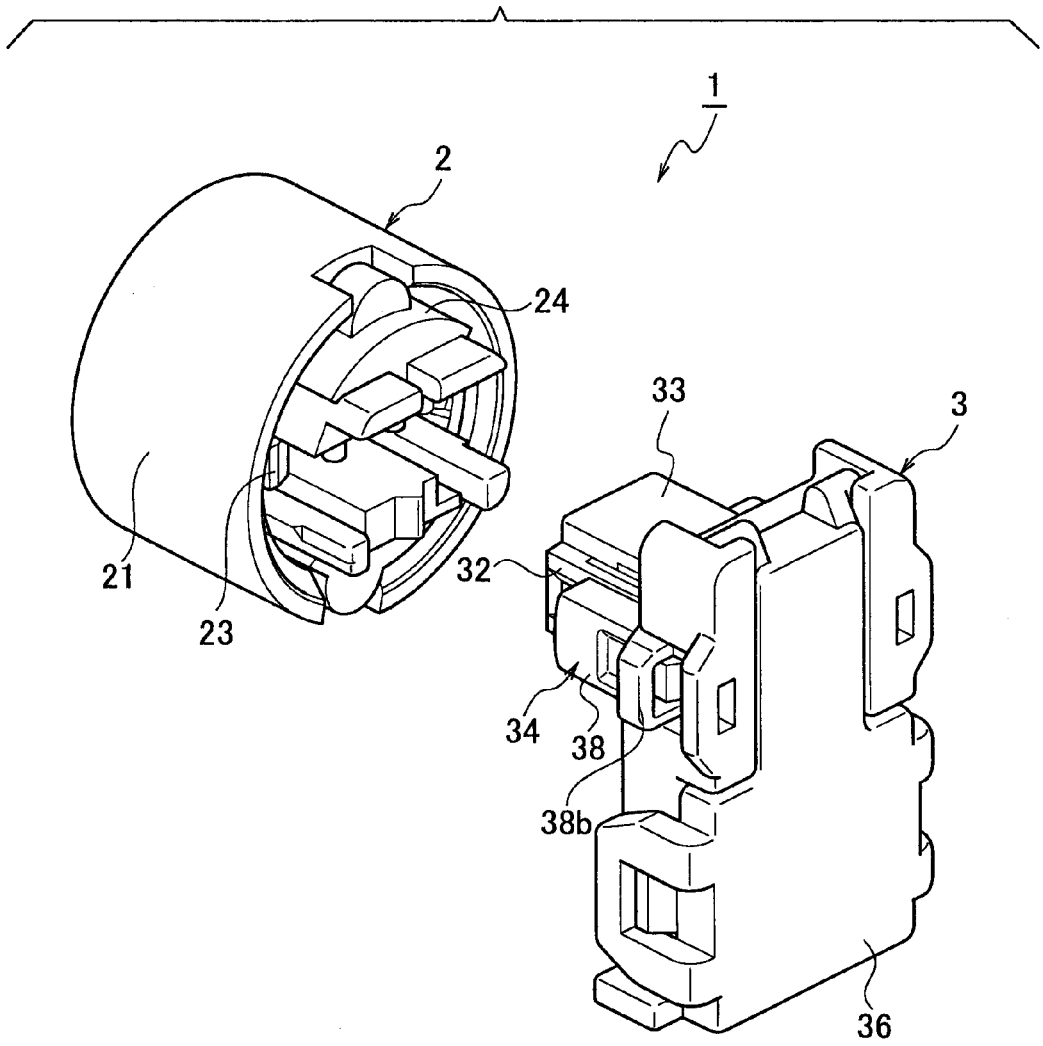
FIG. 1 is a perspective view of a connector structure according to an embodiment.

Hereinafter, an embodiment will be explained with reference to FIG. 1 to FIG. 6. As shown in FIG. 1, a connector structure according to the present embodiment includes a first connector 2 and a second connector 3 that are coupled with each other.

Figure 2:
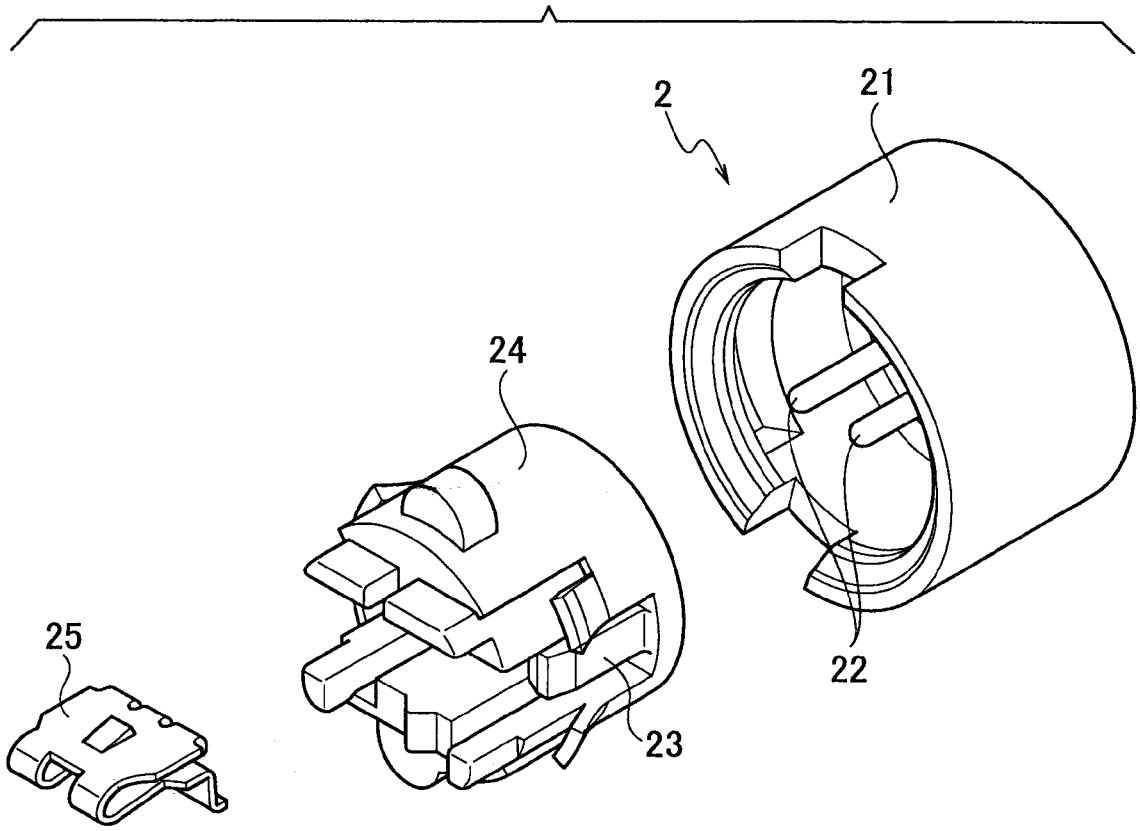
FIG. 2 is an exploded perspective view of a first connector in the embodiment.

As shown in FIG. 2, the first connector 2 includes a first connector housing 21, a pair of first terminals 22, a shunt ring 24, and a short-circuit terminal 25. The shunt ring 24 is provided with a pair of engagement arms 23 (see FIG. 4) each of which can be elastically bent. The short-circuit terminal 25 electrically connects one of the first terminals 22 with another while the first connector 2 is uncoupled with the second connector 3 (so that an electrical current doesn't flow through a device connected with the first terminals 22 [e.g. a squib of an airbag inflator] contingently). The pair of first terminal 22, the shunt ring 24, and the short-circuit terminal 25 are housed in the first connector housing 21.

Figure 3:
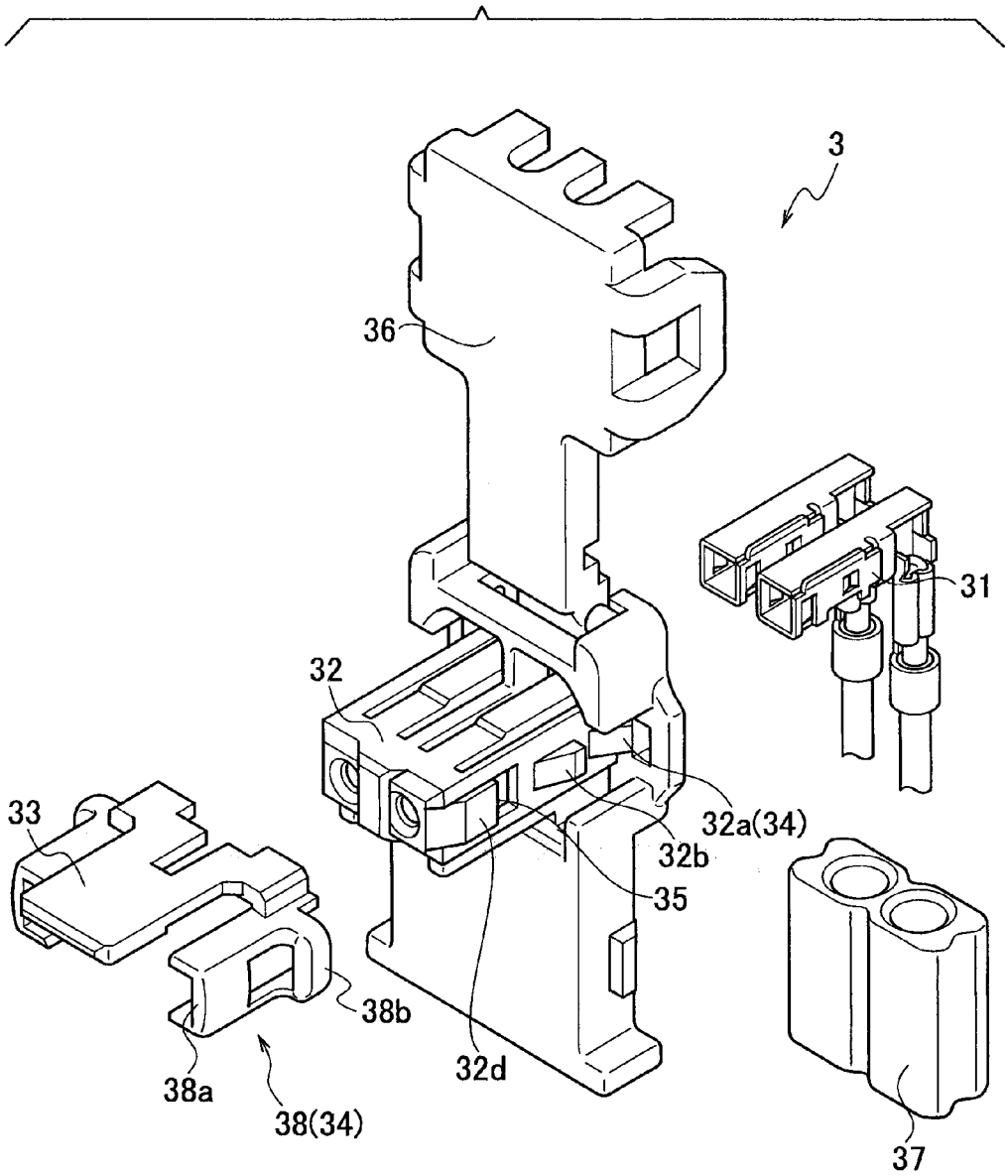
FIG. 3 is an exploded perspective view of a second connector in the embodiment.

As shown in FIG. 3, the second connector 3 includes a second connector housing 32, a pair of second terminals 31, a slider 33, a biasing portion 34, a pair of arm engagement portions 35, a cover 36 and a ferrite core 37. The pair of second terminals 31 is housed in the second connector housing 32, and electrically connected with the pair of first terminals 22. The slider 33 is provided on the second connector housing 32 slidably in a connector coupling direction and a connector decoupling direction. The biasing portion 34 biases the second connector housing 32 in the decoupling direction so as to decouple the second connector 3 from the first connector 2. The pair of arm engagement portions 35 is engaged with the pair of engagement arms 23 when the engagement arms 23 are elastically bent back (explained later). The cover 36 is swingably attached to the second connector housing 32 via a hinge portion, and covers the pair of second terminals 31 and the ferrite core 37 that are installed in the second connector housing 32 when it is closed.

Figure 5B:
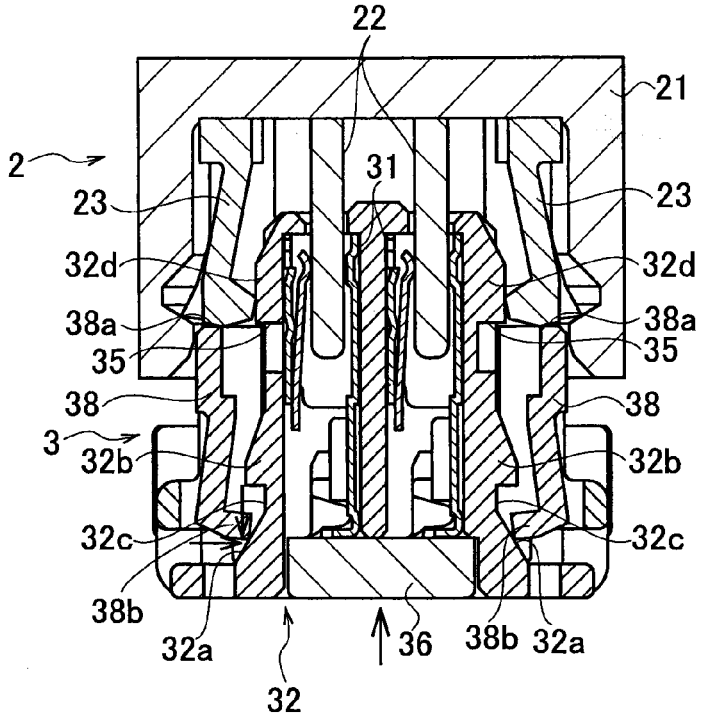
FIG. 5B is a cross-sectional view of the first and second connectors in the embodiment (at a middle stage of coupling)
Figure 6A:
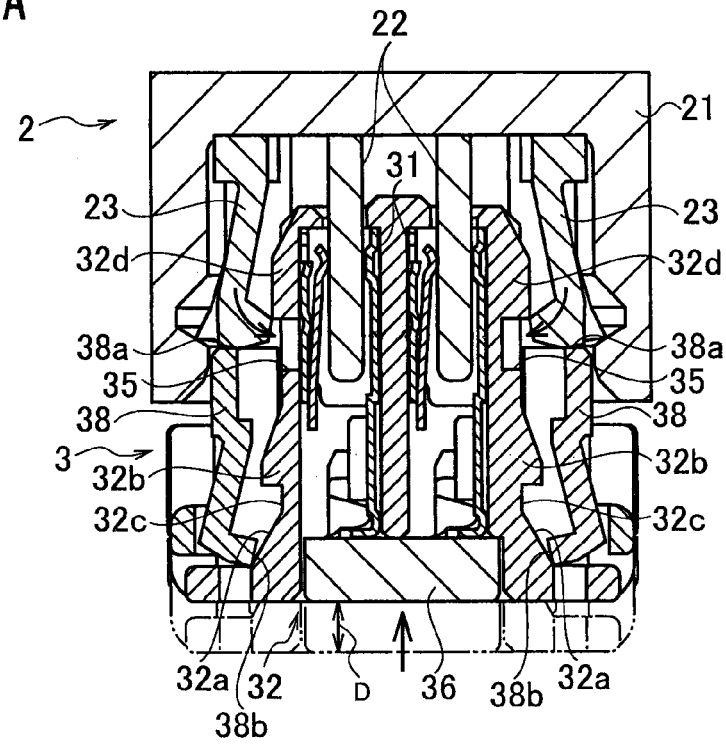
FIG. 6A is a cross-sectional view of the first and second connectors in the embodiment (just before the completion of coupling)

The biasing portions 34 are disposed on both sides of the second connector housing 32, respectively. Each of the biasing portions 34 has an elastically-bendable arm 38 provided on the slider 33 and a tapered surface 32*a* provided on the second connector housing 32. The elastically-bendable arm 38 is elastically bent by the tapered surface 32*a* during coupling the connectors 2 and 3. As shown in FIG. 5B and FIG. 6A, according to the biasing portions 34, while the elastically-bendable arms 38 are elastically bent by the tapered surfaces 32*a*, respectively, the second connector housing 32 is biased in the connector decoupling direction by a reaction force of elastically-restorative forces of the elastically-bendable arms 38. Hereinafter, this reaction force is referred also as a biasing force.

A first engagement area (provided with a first engagement protrusion 32*d* and an arm engagement portion 35) to be engaged with the engagement arm 23 and a second engagement area (provided with a second engagement protrusion 32*b*, an engagement depression 32*c*, and the tapered surface 32*a*) to be engaged with the elastically-bendable arm 38 are formed on each of both side surfaces of the second connector housing 32. The first engagement areas are formed on a tip-end side of the second connector housing 32 and the second engagement areas are formed on a base-end side of the second connector housing 32. In the first engagement area, the first engagement protrusion 32*d* and the arm engagement portion 35 are sequentially formed in this order from the tip-end side toward the base-end side. In the second engagement area, the second engagement protrusion 32*b*, the engagement depression 32*c*, and the tapered surface 32*a* are sequentially formed in this order from the tip-end side toward the base-end side. The first engagement protrusion(s) 32*d* contacts with the engagement arm(s) 23, and thereby elastically bend the engagement arm(s) 23 (see FIG. 5A to FIG. 6A). The second engagement protrusion(s) 32*b* contacts with the elastically-bendable arm(s) 38, and thereby elastically bend the elastically-bendable arm(s) 38 (see FIG. 5B and FIG. 6A). The elastically-bendable arm(s) 38 is to be engaged with the engagement depression(s) 32*c*.

As shown in FIG. 3, the elastically-bendable arm(s) 38 includes a prodded portion 38*a* to be prodded by a tip end of the engagement arm(s) 23 at its one end, and a contacted portion 38*b* to be contacted with the second connector housing 32 at its another end.

Figure 4:
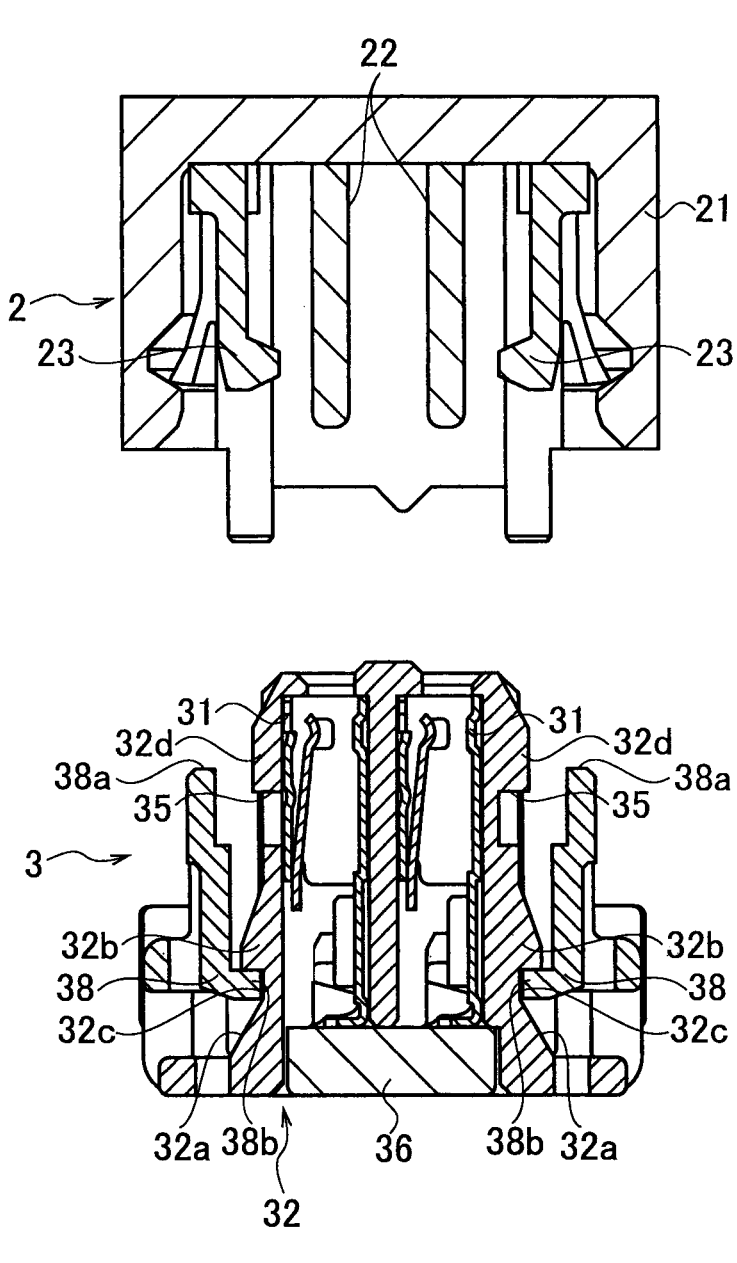
FIG. 4 is a cross-sectional view of the first and second connectors in the embodiment (before coupling)

According to the above-explained configuration, before coupling of the connectors 2 and 3, the engagement arm(s) 23 of the first connector 2 is initially in a straight state without being elastically bent, as shown in FIG. 4. On the other hand, the elastically-bendable arm(s) 38 is also in a straight state without being elastically bent, as shown in FIG. 4, but the contacted portion 38*b* is located in the engagement depression 32*c* of the second connector housing 32, and thereby engaged with the second engagement protrusion 32*b*. Therefore, the elastically-bendable arms 38 prevent the slider 33 from dropping off from the second connector housing 32.

Figure 5A:
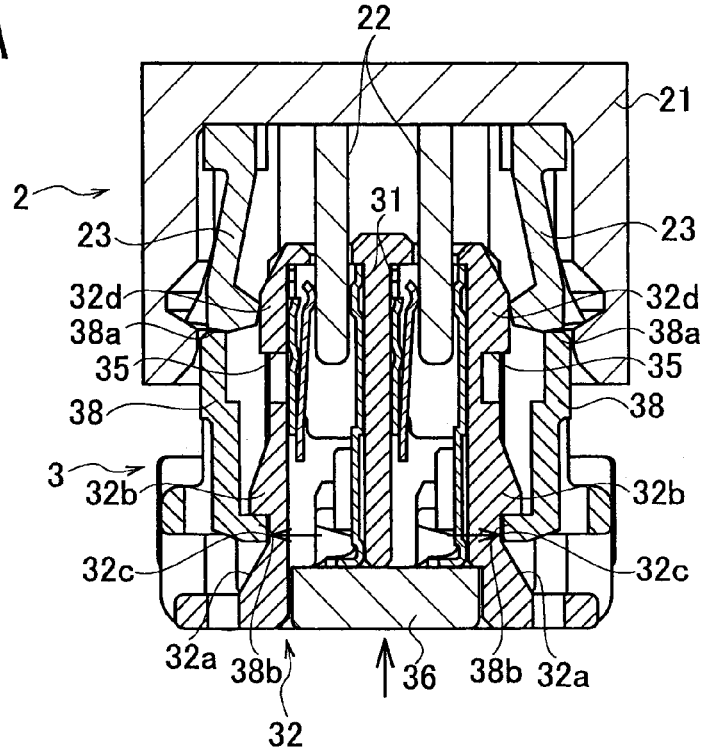
FIG. 5A is a cross-sectional view of the first and second connectors in the embodiment (at an initial stage of coupling)

Initially in a coupling process of the connectors 2 and 3, the tip-end side of the second connector housing 32, a tip end of the slider 33 and the prodded portion 38*a* of the elastically-bendable arms 38 are inserted into the first connector housing 21, and there by the first terminals 22 and the second terminals 31 are electrically connected with each other, respectively, as shown in FIG. 5A. Note that, due to the insertion of the second connector 3 into the first connector 2, the short-circuit terminal 25 shown in FIG. 2 is bent by the first connector housing 21 to be disconnected with the first terminals 22 before the first terminals 22 and the second terminals 31 are electrically connected with each other.

Concurrently, the engagement arms 23 of the first connector housing 21 contact with the first engagement protrusions 32*d* of the second connector housing 32, respectively, as shown in FIG. 5A, and thereby the engagement arms 23 are elastically-bent outward by the first engagement protrusions 32*d*, respectively. Since the engagement arms 23 are elastically-bent outward, the second connector housing 32 is allowed to be inserted in the connector coupling direction (upward in FIG. 5A). As a result, the tip ends of the engagement arms 23 prod the prodded portions 38*a* of the elastically-bendable arms 38, respectively, as shown in FIG. 5A.

When the second connector housing 32 is further pushed into the first connector housing 21 in the connector coupling direction as shown in FIG. 5B, the elastically-bendable arms 38 are pushed by the engagement arms 23, respectively, and thereby the elastically-bendable arms 38 (the slider 33) are moved toward the base-end side of the second connector housing 32 (downward in FIG. 5B: in the connector) by a pressing force applied from the first connector 2 against the biasing force generated by the biasing portion 34. Therefore, the contacted portions 38*b* of the elastically-bendable arms 38 are slid, from the engagement depressions 32*c*, along the tapered surface 32*a*, respectively. As a result, the elastically-bendable arms 38 are gradually and elastically bent outward, and thereby the elastically-restorative forces of the elastically-bendable arms 38 (the biasing portions) generate the above-mentioned biasing force so as to decouple the connectors 2 and 3.

Namely, while the second connector housing 32 is further pushed into the first connector housing 21 as shown in FIG. 5B, the second connector housing 32 is pushed against this biasing force generated by the biasing portions (the elastically-bendable arms 38 and the tapered surfaces 32*a*). If pushing of the second connector housing 32 toward the first connector housing 21 is stopped in an insufficient coupling state of the connectors 2 and 3 as shown in FIG. 5B, the second connector housing 32 is pushed back by the above-explained biasing force generated by the biasing portions (the elastically-bendable arms 38 and the tapered surfaces 32*a*). As a result, the insufficient coupling state is forcibly cancelled by the biasing force generated by the biasing portions (the elastically-bendable arms 38 and the tapered surfaces 32*a*).

In the present embodiment, the biasing portion 34 is provided in a pair, as explained above. In addition, one of the biasing portions 34 (e.g. right side in FIG. 5B) and another of biasing portions 34 (e.g. left side in FIG. 5B) are arranged line-symmetrically to generate the elastically-restorative force generated by the right-side elastically-bendable arm 38 and the elastically-restorative force generated by the left-side elastically-bendable arm 38 oppositely. The above-mentioned biasing force is generated as a resultant force of the reaction force of the elastically-restorative force generated by the right-side elastically-bendable arm 38 and the reaction force of the elastically-restorative force generated by the left-side elastically-bendable arm 38.

Subsequently, when the second connector 3 is further inserted into the first connector 2 as shown in FIG. 6A (an insertion stroke D from the state shown in FIG. 5A), the contacted portions 38*b* of the elastically-bendable arms 38 reach end edges of the tapered surfaces 32*a*, respectively, and thereby the second connector 3 reaches its engagement position relative to the first connector 2. In an engagement state shown in FIG. 6A, the engagement arms 23 are bent back inward due to their own elastically-restorative forces, respectively, and pawls formed at ends of the engagement arms 23 are engaged with the arm engagement portions 35. As a result, the first connector 2 and the second connector 3 are locked with each other, and prodding of engagement arms 23 with the prodded portions 38*a* is cancelled.

Figure 6B:
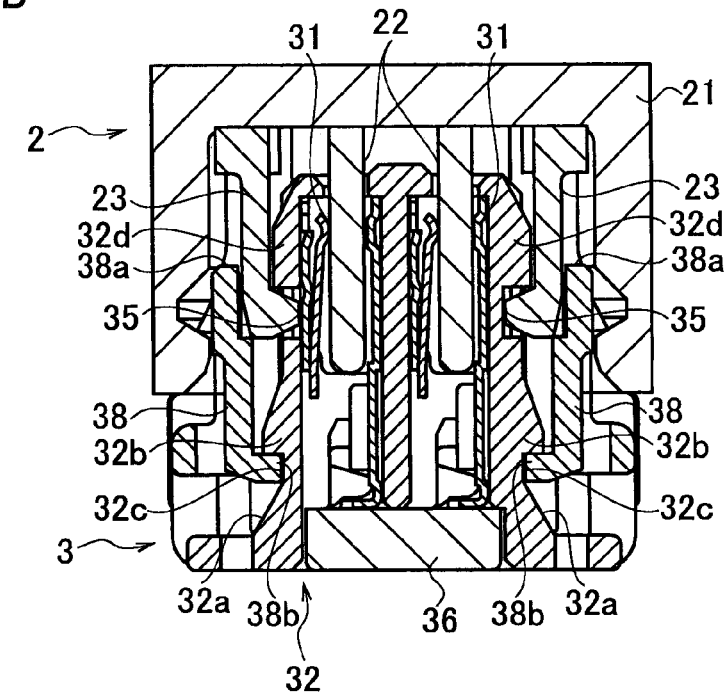
FIG. 6B is a cross-sectional view of the first and second connectors in the embodiment (at the completion of coupling)
Figure 7:
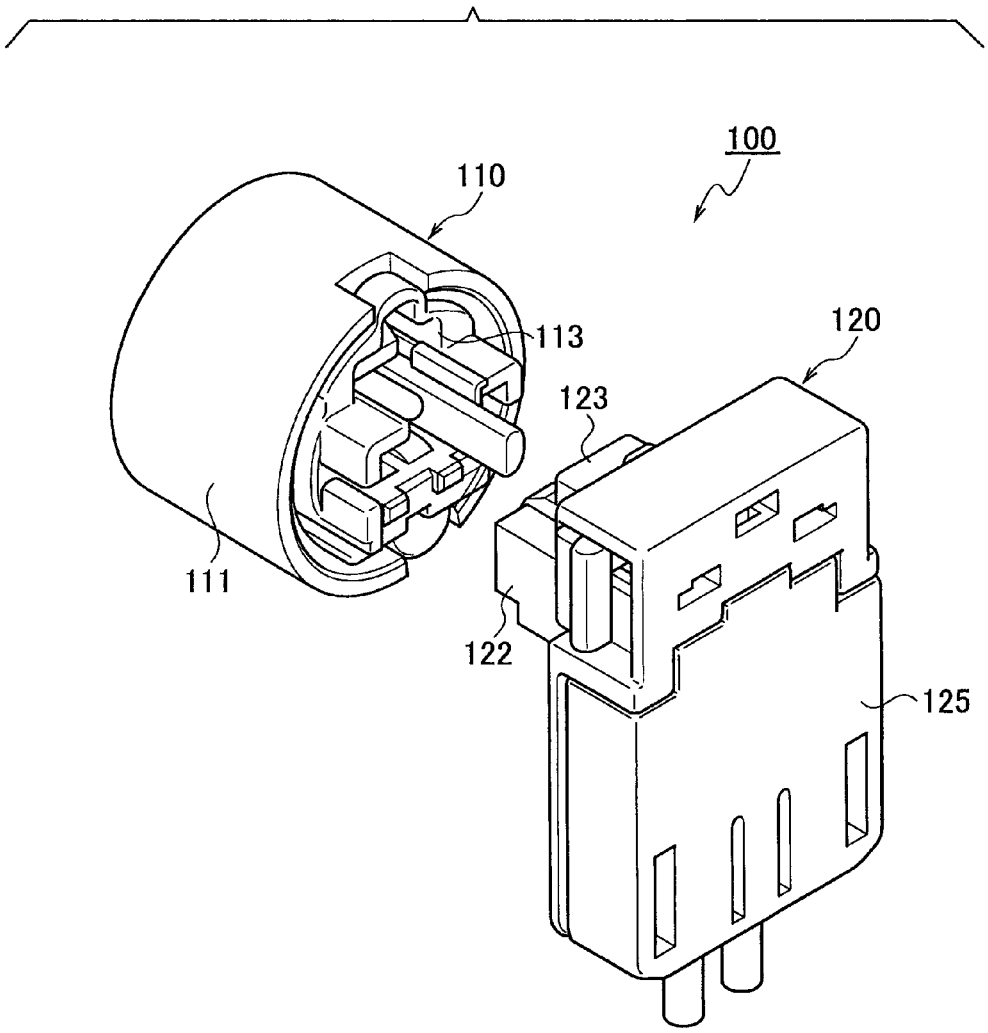
FIG. 7 is a perspective view of a prior-art connector structure.
Figure 8:
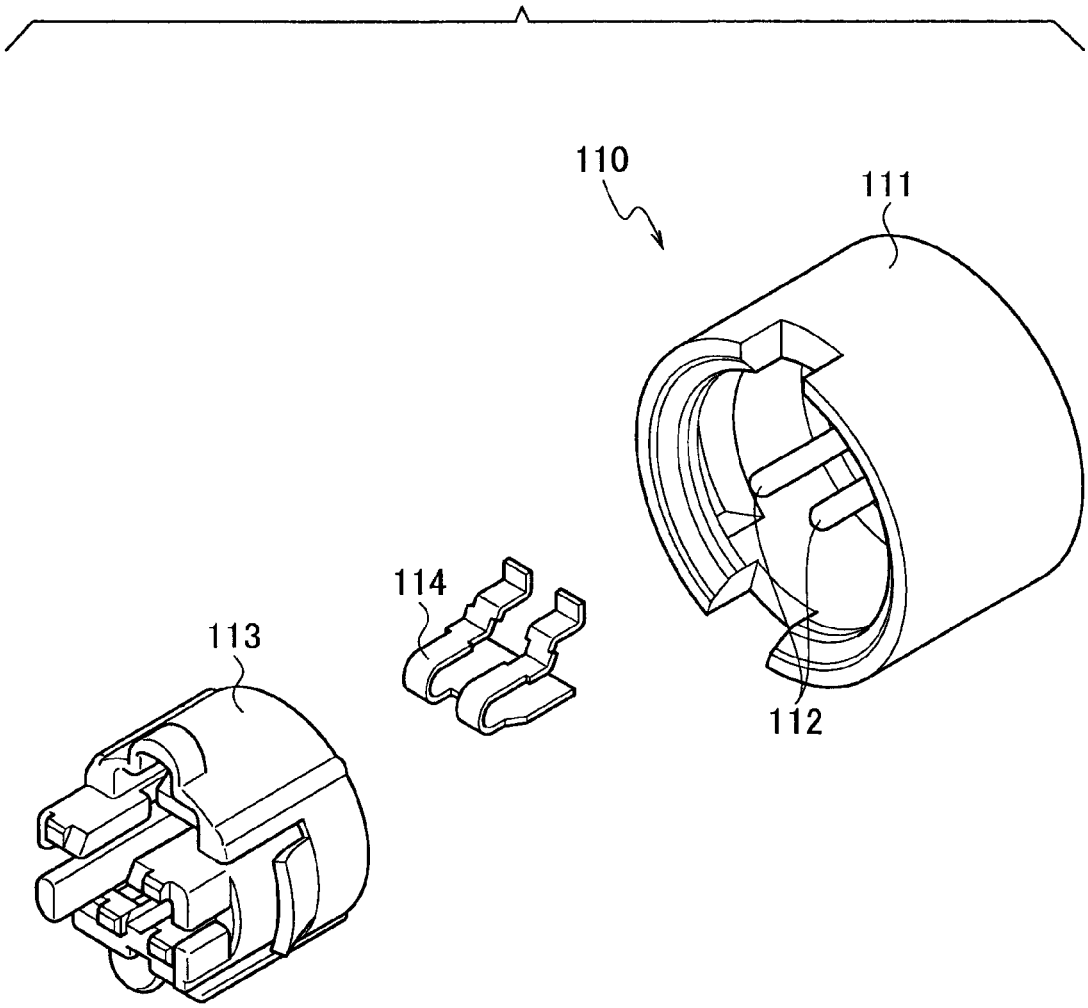
FIG. 8 is an exploded perspective view of a first connector in the prior-art connector structure.

When the prodding of engagement arms 23 with the prodded portions 38*a* is cancelled, the elastically-bendable arms 38 are bent back inward due to their own elastically-restorative forces, respectively, and thereby the elastically-bendable arms 38 (the slider 33) are slid to their initial position on the second connector housing 32, respectively, as shown FIG. 6B (a coupling completion state). The slider 33 pulls the second connector housing 32 (upward in FIG. 6B) due to the engagements of the contacted portions 38*b* and the second engagement protrusion 32*b*. Namely, the elastically-bendable arms 38 (the slider 33) are shifted to spaces between the engagement arms 23 and the first connector housing 21 (i.e. elastically-bent areas of the engagement arms 23), respectively.

Figure 9:
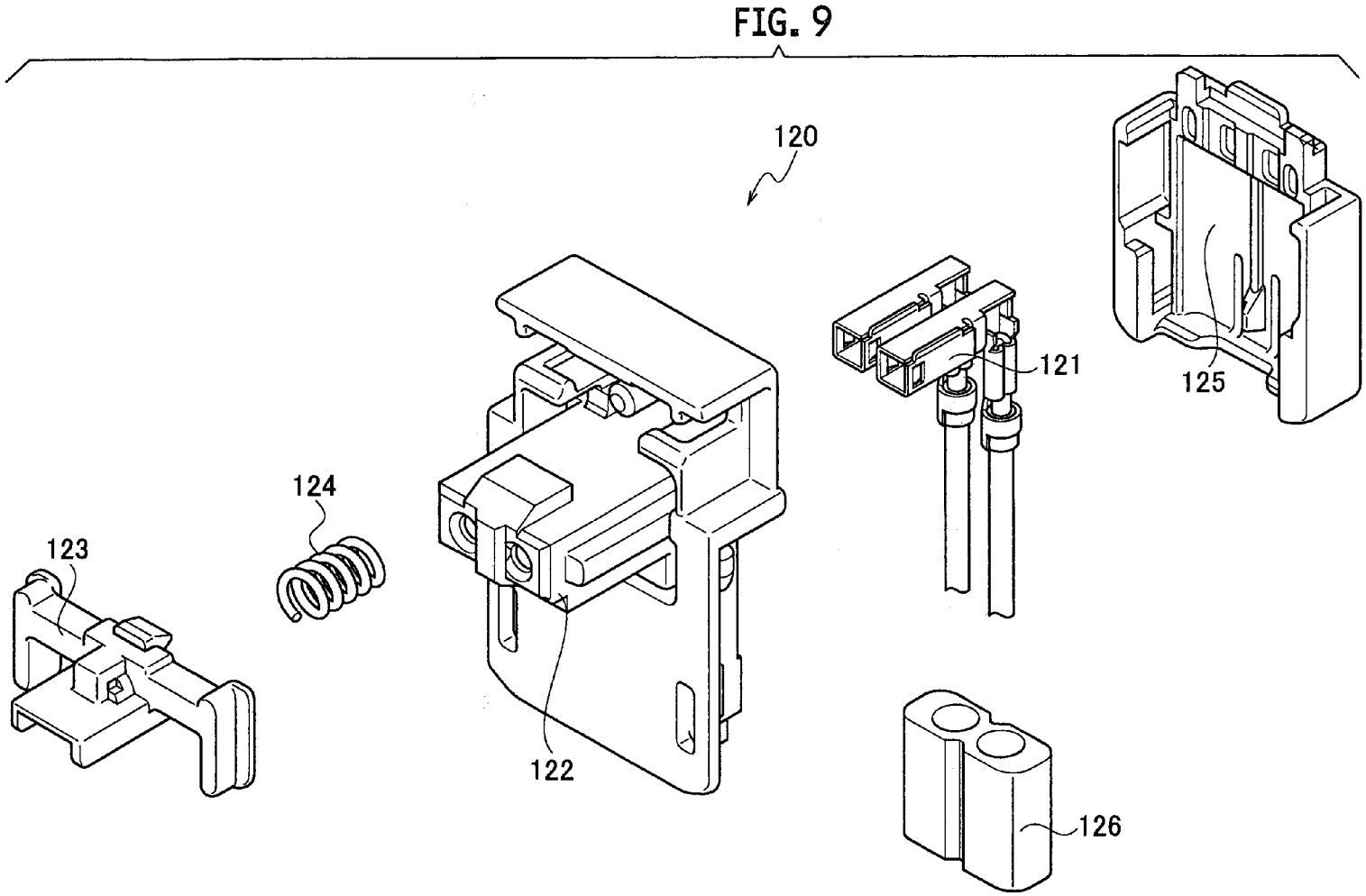
FIG. 9 is an exploded perspective view of a second connector in the prior-art connector structure.
Figure 10:
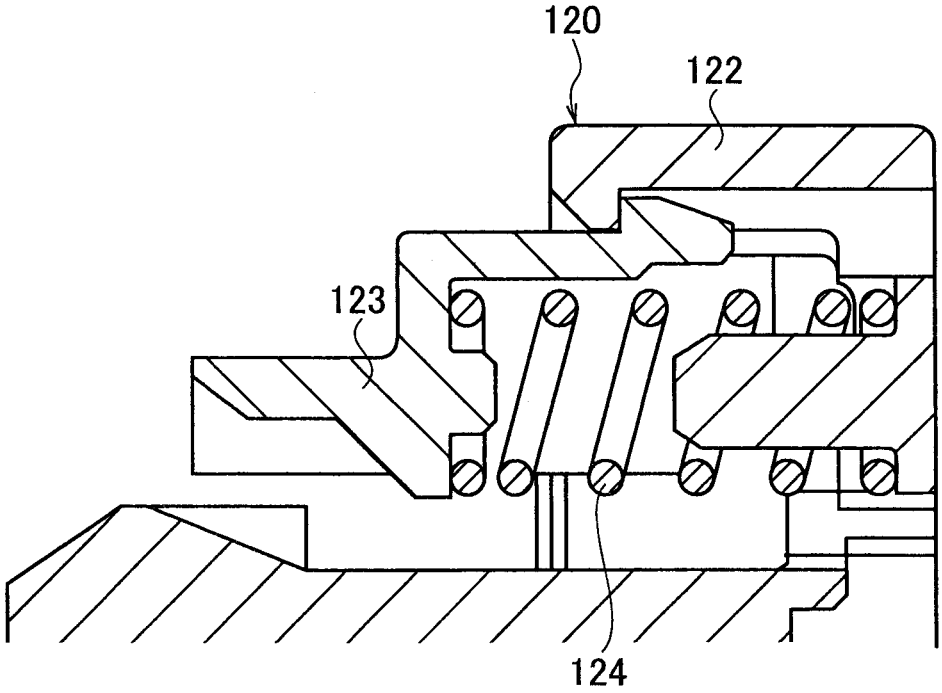
FIG. 10 is an enlarged cross-sectional view of a portion of the second connector in the prior-art connector structure.

As explained above, the biasing portion(s) 34 is provided between the first connector housing 21 (the elastically-bendable arm 38 on the slider 33) and the second connector housing 32 (the tapered surface 32*a* for elastically bending the elastically-bendable arm 38) to generating the biasing force for preventing the insufficient coupling of the connectors 2 and 3. Therefore, according to the present embodiment, the insufficient coupling of the connectors 2 and 3 can be prevented securely without providing a spring member such as the coil spring 124 shown in FIG. 9.

Figure 11:
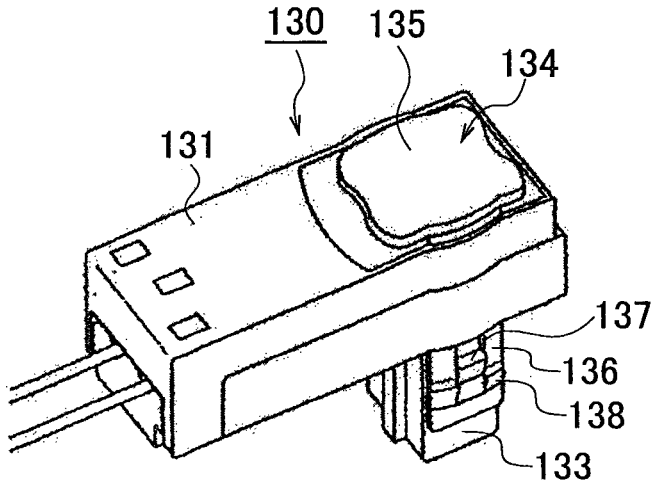
FIG. 11 is a perspective view of another prior-art connector structure.
Figure 11:
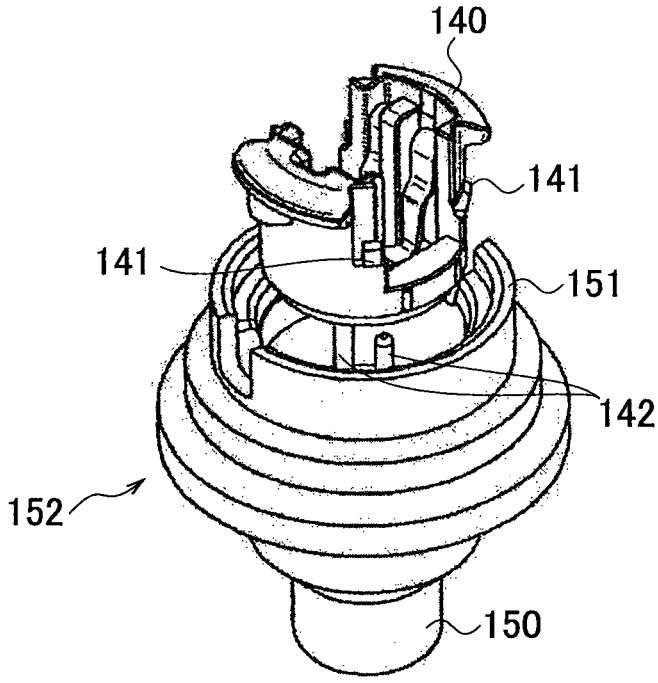
Figure 12:
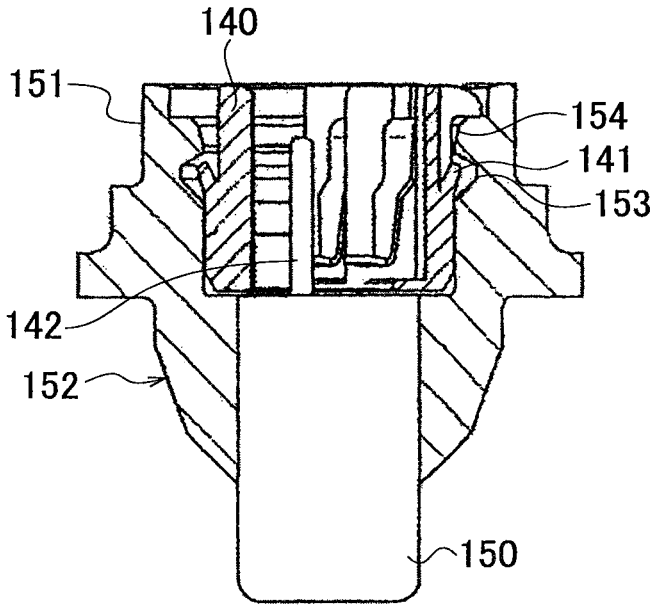
FIG. 12 is a cross sectional view of the other prior-art connector structure.

A supplemental operation, such as the additional push of the slider 134 (the head 135) shown in FIG. 11, is not needed after coupling the connectors 2 and 3 for preventing the insufficient coupling of the connectors 2 and 3. As a result, man hours required for assembling the connector set 1 according to the present embodiment can be reduced and costs for components of the connector set 1 according to the present embodiment can be also reduced, in addition to the above-explained secure prevention of an insufficient coupling of the connectors 2 and 3.

According to the present embodiment, in the coupling completion state shown in FIG. 6B, the engagement arms 23 are prevented from being elastically bent outward, because the elastically-bendable arms 38 are shifted back to the elastically-bent areas of the engagement arms 23. Therefore, the coupling completion state can be maintained securely.

The present invention is not limited to the above embodiments. For example, the slider 33 and the elastically-bendable arms 38 formed integrally (molded as a single component) in the above embodiment and this configuration brings advantages such as simplification of the configuration, reduction of the number of components, and so on. However, they may be formed independently from each other (as separated components).

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The entire contents of Japanese Patent Applications 2013-220002 (filed on Oct. 23, 2013) are incorporated to this Description by reference. Although the invention has been described above by reference to certain embodiments of the invention, the invention is not limited to the embodiments described above. Scope of the invention should be defined in view of Claims.

What is claimed is:

1. A connector structure comprising:

a first connector that includes a first connector housing in which a first terminal is housed, and an engagement arm that can be elastically bent; and a second connector that includes a second connector housing in which a second terminal is housed, a slider that is provided on the second connector housing slidably in a connector coupling direction and a connector decoupling direction, a biasing portion that biases the second connector housing in the connector decoupling direction, and an arm engagement portion engaged with the engagement arm when the engagement arm is elastically bent back, wherein, during a coupling process of the first connector and the second connector, the slider is slid by a pressing force applied from the first connector against a biasing force generated by the biasing portion, in a coupling completion state, the engagement arm is engaged with the arm engagement portion to lock the first connector and the second connector, the biasing portion includes an elastically-bendable arm that is provided on the slider, and a tapered surface that is provided on the second connector housing and contacts with the elastically-bendable arm to bend the elastically-bendable arm during the coupling process, and the biasing force is generated as a reaction force of an elastically-restorative force of the elastically-bendable arm bent by the tapered surface.

2. The connector structure according to claim 1, wherein, during the coupling process, the engagement arm is bent so as to be contacted with the elastically-bendable arm, the elastically-bendable arm provided on the slider is moved by being pushed by the engagement arm against the biasing force, and the engagement arm is bent back and the elastically-bendable arm is moved back to an elastically bent area of the engagement arm between the engagement arm and the first connector housing when the coupling process is completed.

3. The connector structure according to claim 1, wherein the elastically-bendable arm is formed integrally with the slider.

4. The connector structure according to claim 1, wherein the biasing portion is provided in a pair, one of the biasing portions and another of biasing portions are arranged line-symmetrically to generate the elastically-restorative force generated by the one and the elastically-restorative force generated by the other oppositely, and the biasing force is generated as a resultant force of the reaction force of the elastically-restorative force generated by the one and the reaction force of the elastically-restorative force generated by the other.

* * * * *